US006345415B1

(12) United States Patent
Laning

(10) Patent No.: US 6,345,415 B1
(45) Date of Patent: Feb. 12, 2002

(54) SELF-CAPTIVATING PINLESS HINGE

(75) Inventor: Ray Clement Laning, Rochester, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/390,258

(22) Filed: Sep. 3, 1999

(51) Int. Cl.[7] ..... E05D 5/00
(52) U.S. Cl. ..... 16/268; 16/266; 49/381
(58) Field of Search ..... 16/227, 249, 254, 16/259, 268, 266, 271; 403/353; 49/381; 381/610, 616

(56) References Cited

U.S. PATENT DOCUMENTS

| | | | | | |
|---|---|---|---|---|---|
| 709,762 | A | * | 9/1902 | Greaves | 403/353 |
| 1,769,645 | A | * | 7/1930 | Hummelgard | 403/353 |
| 2,712,915 | A | * | 7/1955 | Cohen | 16/268 |
| 4,296,525 | A | * | 10/1981 | Schmid | 16/168 |
| 4,658,547 | A | * | 4/1987 | Oboza | 49/386 |
| 4,688,305 | A | * | 8/1987 | MacKirdy | 16/266 |
| 4,704,604 | A | * | 11/1987 | Fuhs | 340/700 |
| 4,712,814 | A | * | 12/1987 | Petterson | 403/353 |
| 4,725,080 | A | * | 2/1988 | Langer | 296/37.12 |
| 4,840,514 | A | * | 6/1989 | Defrance et al. | 16/260 |
| 5,017,039 | A | * | 5/1991 | Spiess et al. | 16/254 |
| 5,054,723 | A | * | 10/1991 | Arnold | 248/65 |
| 5,727,871 | A | * | 3/1998 | Kotloff | 362/225 |
| 5,745,953 | A | * | 5/1998 | Golden | 16/260 |
| 5,784,839 | A | * | 7/1998 | La Vanway | 52/204.1 |
| 6,058,565 | A | * | 5/2000 | Jeong | 16/382 |

* cited by examiner

*Primary Examiner*—Anthony Knight
*Assistant Examiner*—Mark Williams
(74) *Attorney, Agent, or Firm*—Bracewell & Patterson LLP

(57) ABSTRACT

A hinge assembly has a hinge door that is pivotally mounted to a hinge base. The door has a flat body with a pair of square tabs extending laterally from one end. The hinge base has a flat frame with a rectangular aperture. A pair of parallel, rigid flanges extend from the aperture in the frame. Each flange has an entry hole that leads into a diagonal slot. The slots terminate in circular recesses. The hinge door is installed in the hinge base to form the assembly by initially positioning the tabbed end of the door diagonally in the aperture. The tabs are then elevated slightly above the frame and rotated into alignment with the entry holes. The door is angled into alignment with the diagonal slots and lowered in that plane. This motion causes the tabs to move past the entry holes, through the slots, and into the circular recesses to form the hinge assembly. The recesses closely receive the tabs on the door to allow pivotal motion therebetween.

4 Claims, 3 Drawing Sheets

SELF-CAPTIVATING PINLESS HINGE

BACKGROUND OF THE INVENTION

1. Technical Field

This invention relates in general to hinge mechanisms and in particular to a self-captivating, pinless hinge.

2. Background Art

In mechanical closure designs, there is a consistent need and preference to have doors or access panels hinge out of the way rather than be entirely removed from the underlying structure. This is usually accomplished by inserting a pin into a series of hinge curls extending from the door and the base it is mounted to. In the computer and electronic industry, another common method is to insert tabs into holes in mating parts. The tabs rotate in the holes to provide the hinge feature. Although these two hinging methods are widely used, they have disadvantages.

One problem with these types of hinges is their installation difficulty. For example, hinges that use the pin and curls design can be difficult to access due to the space required to properly insert the pin into the hinge curls. Larger hinges with long pins require even greater space for installation. Other problems with this design include pin retention and cost. During shipping or other high vibration environments, the pin can eventually work itself free of the hinge curls. The cost of the pin and hinge curls are relatively high due to tooling costs and the labor time involved in installing the pin.

Hinges that use the tab and hole design require the assembly of multiple parts at initial set up in order to support the hinged door or panel. In addition, this design occasionally requires the parts to be temporarily bent or deformed in order to insert the tabs into the holes of the mating parts. Thus, a hinge that is easy to install and retain in its underlying support structure while significantly reducing or eliminating installation cost and tooling is needed.

SUMMARY OF THE INVENTION

A hinge assembly has a hinge door that is pivotally mounted to a hinge base. The door has a flat body with a pair of square tabs extending laterally from one end. The hinge base has a flat frame with a rectangular aperture. A pair of parallel, rigid flanges extend from the aperture in the frame. Each flange has an entry hole that leads into a diagonal slot. The slots terminate in circular recesses.

The hinge door is installed in the hinge base to form the assembly by initially positioning the tabbed end of the door diagonally in the aperture. The tabs are then elevated slightly above the frame and rotated into alignment with the entry holes. The door is angled into alignment with the diagonal slots and lowered in that plane. This motion causes the tabs to move past the entry holes, through the slots, and into the circular recesses to form the hinge assembly. The recesses closely receive the tabs on the door to allow pivotal motion therebetween.

BRIEF DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

BEST MODE FOR CARRYING OUT THE INVENTION

Figure 1:
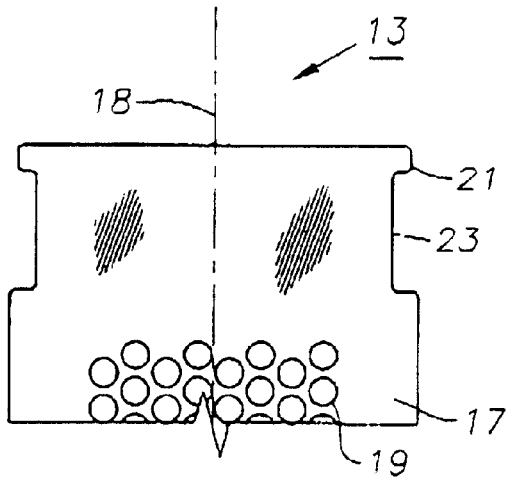
FIG. 1 is a front view of a pivot portion of a hinge door that is constructed in accordance with the invention.
Figure 6:
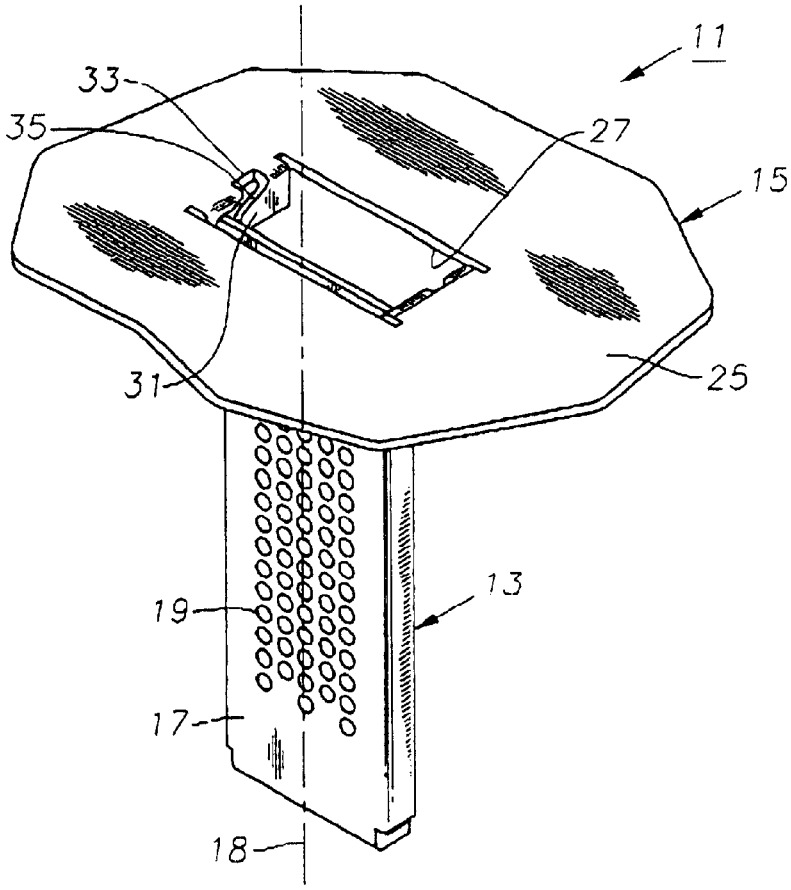
FIG. 6 is a front isometric view of the hinge assembly of FIG. 4 at a final stage of installation.

Referring to FIG. 6, a hinge assembly 11 that is ideally suited for an electronic or computer device is shown. Assembly 11 comprises a hinge door member 13 that is pivotally mounted to a hinge base 15. The proximal or hinge end of hinge door 13 is shown in FIG. 1. In one embodiment, door 13 has a substantially flat, rectangular body 17 with a longitudinal axis 18 and a plurality of holes 19. Holes 19 are provided for increasing air flow but are not necessary for the invention. Door 13 is symmetrical about axis 18, and may be formed in many different shapes and configurations depending on the specific application.

A flat square tab 21 extends laterally from each side of door 13 on its proximal end. Tabs 21 lie in the same plane as body 17, but are orthogonally oriented relative to it. The transverse width of door 13 across tabs 21 (perpendicular to axis 18) is slightly less than its width at the lower portion of body 17. Door 13 also has a short rectangular notch 23 formed in each lateral side between body 17 and each tab 21. Notches 23 have lower orthogonal shoulders 24 that face tabs 21. The width of door 13 at shoulders 24 is preferably slightly greater than the width of door 13 at tabs 21.

Figure 2:
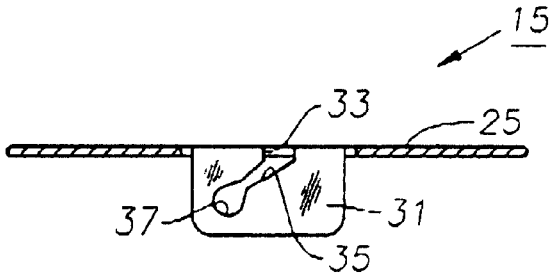
FIG. 2 is a side view of a hinge base for use with the hinge door of FIG. 1.
Figure 3:
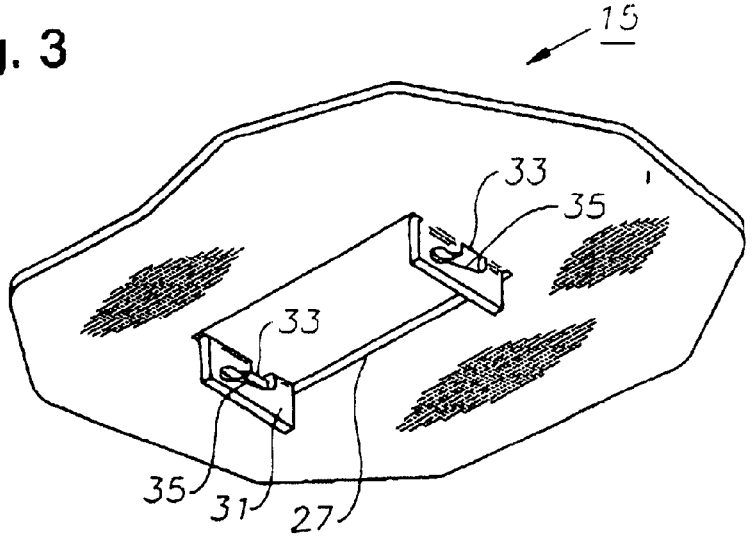
FIG. 3 is a lower isometric view of the hinge base of FIG. 2.
Figure 4:
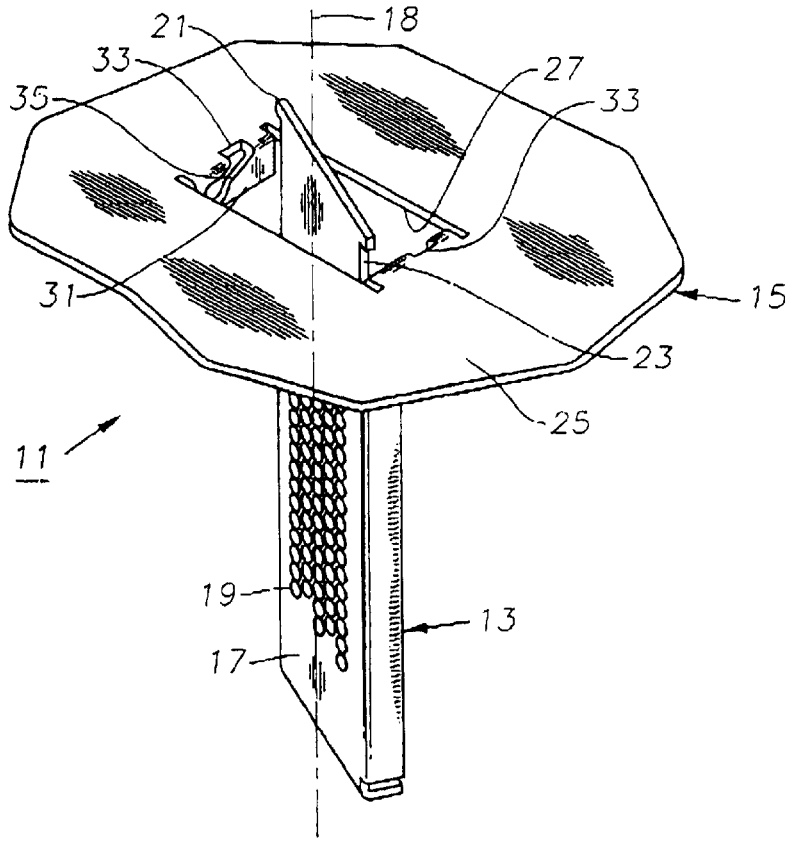
FIG. 4 is a front isometric view of a hinge assembly comprising the hinge door of FIG. 1 and the hinge base of FIG. 2 at an initial stage of installation.

As shown in FIGS. 2 and 3, hinge base 15 comprises a substantially flat frame 25 with a generally rectangular aperture 27. Frame 25 has a pair of parallel, rigid, rectangular flanges 31 that extend perpendicularly downward from aperture 27 in frame 25. Flanges 31 are symmetrical to one another and each has a square entry hole 33 formed between it and frame 25 at their interface. Each hole 33 leads into a diagonally-oriented slot 35 in its respective flange 31. Slots 35 terminate in circular recesses 37. The hole 33, slot 35, and recess 37 in each flange 31 are integrally formed as a closed receptacle with a single point of entry. Note that slots 35 taper down in width in an intermediate portion between holes 33 and recesses 37. The diameter of recesses 37 are slightly larger than the axial length of tabs 21 on door 13, and are also larger than the widths of slots 35 at the intermediate portions. The axial length of each tab 21 is greater than the width of slot 35 at its narrow intermediate portion. The transverse dimension of door 13 at tabs 21 (its hinge end) between its outer edges is greater than the transverse distance between flanges 31. The transverse dimension at tabs 21 is less than a diagonal dimension of aperture 27, as shown in FIG. 4. However, the transverse dimension of body 17 at and below shoulders 24 is greater than the diagonal dimension of aperture 27.

In operation, hinge door 13 must first be installed in hinge base 15 to form assembly 11. As shown in FIG. 4, door 13 is initially skewed or rotated about axis 18 relative to base 15 such that the upper or hinge end of door 13 is diagonally oriented in aperture 27. Next, door 13 is positioned in aperture 27 such that tabs 21 are slightly elevated above frame 25 as shown. Door 13 is then rotated into orthogonal alignment with aperture 27 so that tabs 21 are located directly above entry holes 33.

Figure 5:
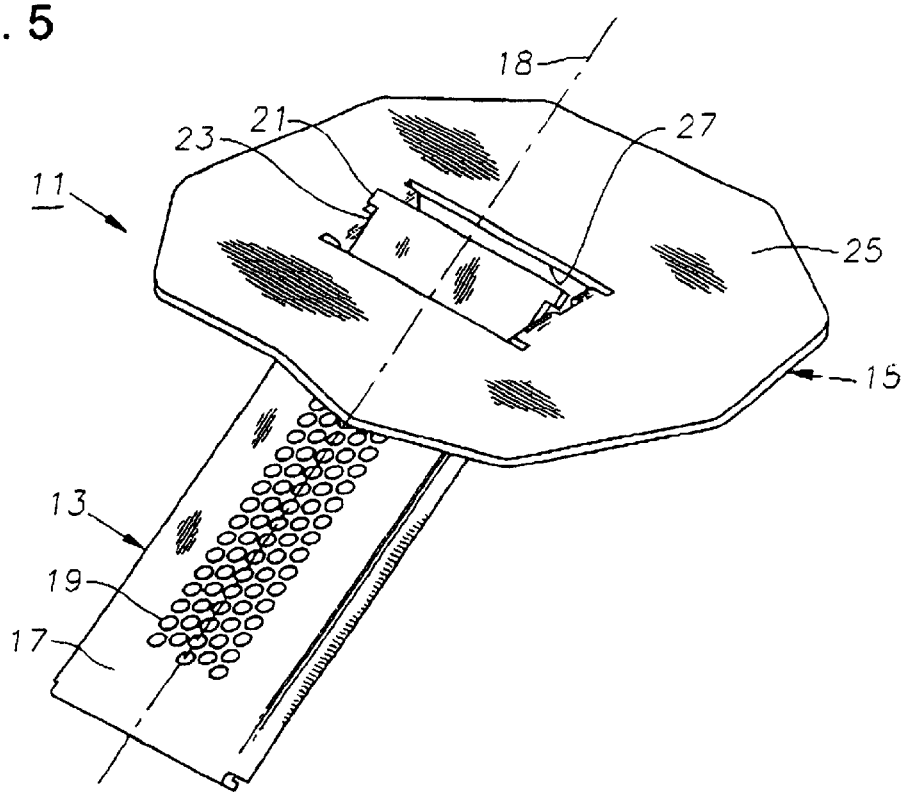
FIG. 5 is a front isometric view of the hinge assembly of FIG. 4 at an intermediate stage of installation.

As shown in FIG. 5, door 13 is pivoted about tabs 21 and lowered into holes 33 in the direction of the arrow. This motion causes tabs 21 to move through holes 33 into slots 35. The flat sides of tabs 21 are roughly parallel to the diagonal orientation of slots 35 during this step. When tabs 21 have bottomed out and are seated in and engaged by circular recesses 37, door 13 is pivoted about tabs 21 relative to base 15 to a substantially vertical or orthogonal position (FIG. 6). Door 13 is now fully installed in base 15 to form hinge assembly 11. Door 13 can only be removed by manipulating the hinge end back through aperture 27 by reversing the steps described above. To remove or install door 13, the hinge end must be moved beyond the upper or rearward side of base 25. If base 25 is mounted flush to a frame, this cannot be done, thereby locking door 13 to hinge base 15.

Figure 7:
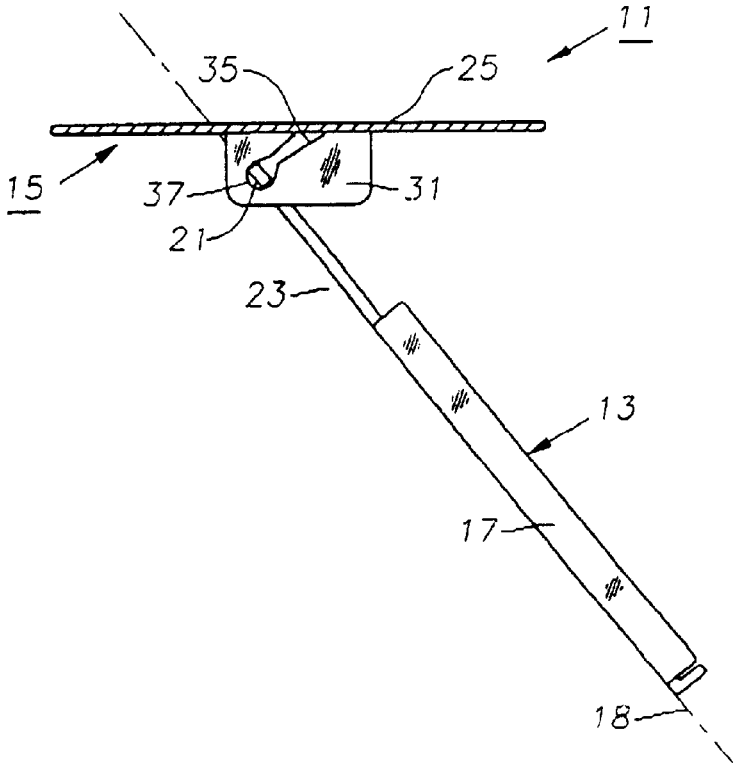
FIG. 7 is a side view of the hinge assembly of FIG. 4 in operation.

As shown in FIG. 7, door 13 is pivotable to selected positions in a hinge-like manner about the hinge end. Since the diameters of recesses 37 are only slightly larger than the axial dimension of tabs 21, and the transverse dimension of the hinge end is greater than the transverse distance between flanges 31, door 13 is retained in base 15 throughout its full range of motion (approximately 180 degrees) relative to base 15.

The invention has several advantages. This hinge design is very easy and inexpensive to install, and requires a minimal amount of space during installation. The door may be inserted or removed even in compact areas without having to assemble or bend any parts. The hinge is also inexpensive to manufacture. In addition, this hinge has a significantly improved retention capability while performing in the same manner as prior art hinges. The angled slot in the flanges allows the door to be retained throughout its range of motion. The door is unable to rotate back to its installation position without intervention.

While the invention has been shown or described in only some of its forms, it should be apparent to those skilled in the art that it is not so limited, but is susceptible to various changes without departing from the scope of the invention.

I claim:

1. A hinge assembly for a housing, comprising:

a hinge base having a rearward side for mounting to the housing, a forward side opposite the rearward side, and an aperture therethrough;

a pair of parallel flanges extending orthogonally in a forward direction from the base on opposite side edges of the aperture, each of the flanges defining a corner at its junction with the base;

a receptacle in each of the flanges, each of the receptacles having a rearward portion located at the corner and extending partially into the base, each receptacle having a forward portion located forward of the corner;

a door member pivotally mounted to the base between the flanges, the door member having a longitudinal axis and a pair of symmetrical tabs on a hinge end that releasably engage the receptacles in the flanges to pivotally connect the door member to the hinge base; wherein the door member has a transverse dimension perpendicular to the longitudinal axis at the hinge end that is greater than the distance between the flanges, but less than a distance between the rearward portions of the receptacles to enable the tabs to be inserted into the rearward portions; wherein the door member has a range of motion of approximately 180 degrees relative to the base while the tabs are located in the forward portions of the receptacles; and wherein the forward portions of the receptacles have a reduced width portion between their respective rearward portions, the reduced width portions being lesser in width than an axial length of each of the tabs.

2. The hinge assembly of claim 1 wherein the aperture has a diagonal dimension that is greater than the transverse dimension at the hinge end of the door member, the diagonal dimension being measured from an edge of one of the flanges to an opposite edge of the other of the flanges.

3. The hinge assembly of claim 1 wherein the forward portions of the receptacles are diagonally oriented relative to the base.

4. The hinge assembly of claim 1 wherein the tabs on the door member are substantially flat and rectangular.

* * * * *